US009324274B2

(12) United States Patent
Kim

(10) Patent No.: US 9,324,274 B2
(45) Date of Patent: Apr. 26, 2016

(54) ORGANIC LIGHT EMITTING DISPLAY DEVICE, AND METHOD OF GENERATING A GAMMA REFERENCE VOLTAGE FOR THE SAME

(71) Applicant: Min-Weun Kim, Yongin (KR)

(72) Inventor: Min-Weun Kim, Yongin (KR)

(73) Assignee: SAMSUNG DISPLAY CO., LTD., Yongin, Gyeonggi-Do (KR)

( * ) Notice: Subject to any disclaimer, the term of this patent is extended or adjusted under 35 U.S.C. 154(b) by 186 days.

(21) Appl. No.: 13/901,633

(22) Filed: May 24, 2013

(65) Prior Publication Data

US 2014/0111402 A1 Apr. 24, 2014

(30) Foreign Application Priority Data

Oct. 19, 2012 (KR) ..... 10-2012-0116439

(51) Int. Cl.
*G09G 3/30* (2006.01)
*G09G 3/32* (2006.01)

(52) U.S. Cl.
CPC ..... *G09G 3/3291* (2013.01); *G09G 3/3225* (2013.01); *G09G 2300/0842* (2013.01); *G09G 2320/0276* (2013.01)

(58) Field of Classification Search
CPC ..... G09G 3/3275; G09G 3/3258; G09G 2320/0276; G09G 2320/0673; G09G 2330/028
See application file for complete search history.

(56) References Cited

U.S. PATENT DOCUMENTS

| | | | | |
|---|---|---|---|---|
| 2006/0061292 | A1* | 3/2006 | Koh et al. | 315/169.3 |
| 2006/0245521 | A1 | 11/2006 | Kim | |
| 2008/0142827 | A1 | 6/2008 | Choi et al. | |
| 2009/0034354 | A1* | 2/2009 | Resnick | 365/228 |
| 2009/0108744 | A1* | 4/2009 | Park et al. | 313/504 |
| 2010/0321362 | A1* | 12/2010 | Weng | 345/211 |
| 2011/0187693 | A1* | 8/2011 | Chung | 345/211 |

FOREIGN PATENT DOCUMENTS

| | | | |
|---|---|---|---|
| JP | 2008-152221 | A | 7/2008 |
| KR | 10-2000-0020856 | A | 4/2000 |
| KR | 10-2006-0114453 | A | 11/2006 |

* cited by examiner

*Primary Examiner* — Kumar Patel
*Assistant Examiner* — Insa Sadio
(74) *Attorney, Agent, or Firm* — Lee & Morse, P.C.

(57) ABSTRACT

An organic light emitting display device includes a scan driving unit configured to provide a scan signal to pixel circuits via a plurality of scan lines, a data driving unit configured to provide a data signal to the pixel circuits via a plurality of data lines, a power unit configured to provide a first power voltage and a second power voltage to the pixel circuits, the first power voltage being greater than the second power voltage, a gamma reference voltage generating unit configured to generate a gamma reference voltage corresponding to a voltage difference between the first power voltage and a subtraction reference voltage, a gamma voltage generating unit configured to generate a plurality of gamma voltages based on the gamma reference voltage, and to provide the gamma voltages to the data driving unit, and a timing control unit.

18 Claims, 7 Drawing Sheets

ORGANIC LIGHT EMITTING DISPLAY DEVICE, AND METHOD OF GENERATING A GAMMA REFERENCE VOLTAGE FOR THE SAME

CROSS-REFERENCE TO RELATED APPLICATION

This application claims priority under 35 USC §119 to Korean Patent Application No. 10-2012-0116439, filed on Oct. 19, 2012 in the Korean Intellectual Property Office (KIPO), and entitled: "ORGANIC LIGHT EMITTING DISPLAY DEVICE, AND METHOD OF GENERATING A GAMMA REFERENCE VOLTAGE FOR THE SAME," which is incorporated by reference herein in its entirety.

BACKGROUND

1. Field

Embodiments relate to an organic light emitting display device, and a method of generating a gamma reference voltage for the same.

2. Description of the Related Art

Recently, an organic light emitting display device is widely used as a flat panel display device as an electronic device is manufactured in a smaller size and consumes lower power. Generally, an organic light emitting display device employing an analog driving technique may include a plurality of pixel circuits in a display panel.

SUMMARY

Embodiments are directed to an organic light emitting display device, including a display panel having a plurality of pixel circuits, a scan driving unit configured to provide a scan signal to the pixel circuits via a plurality of scan lines, a data driving unit configured to provide a data signal to the pixel circuits via a plurality of data lines, a power unit configured to provide a first power voltage and a second power voltage to the pixel circuits, the first power voltage being greater than the second power voltage, a gamma reference voltage generating unit configured to generate a gamma reference voltage corresponding to a voltage difference between the first power voltage and a subtraction reference voltage, a gamma voltage generating unit configured to generate a plurality of gamma voltages based on the gamma reference voltage, and to provide the gamma voltages to the data driving unit, and a timing control unit configured to control at least one of the scan driving unit, the data driving unit, the power unit, the gamma reference voltage generating unit, and the gamma voltage generating unit.

The device may operate based on an analog driving technique.

Each of the pixel circuits may include a switching transistor having a first terminal coupled to one of the data lines, a second terminal coupled to a first node, and a gate terminal coupled to one of the scan lines, a storage capacitor having a first terminal coupled to the first power voltage and a second terminal coupled to the first node, a driving transistor having a first terminal coupled to the first power voltage and a gate terminal coupled to the first node, and an organic light emitting diode having a cathode coupled to the second power voltage and an anode coupled to a second terminal of the driving transistor.

The gamma reference voltage may increase as the first power voltage increases, the gamma voltage increases as the gamma reference voltage increases, and a voltage of the first node may increase as the gamma voltage increases.

The gamma reference voltage may decrease as the first power voltage decreases, the gamma voltage decreases as the gamma reference voltage decreases, and a voltage of the first node may decrease as the gamma voltage decreases.

The at least one of the scan driving unit, the data driving unit, the power unit, the gamma reference voltage generating unit, and the gamma voltage generating unit may be coupled to the display panel using a chip-on-flexible printed circuit, a chip-on-glass, or a flexible printed circuit.

The gamma reference voltage generating unit may include a voltage divider configured to generate the subtraction reference voltage by performing a voltage division on an external reference voltage received from outside, and a subtractor configured to generate the gamma reference voltage by subtracting the subtraction reference voltage from the first power voltage.

The voltage divider may correspond to at least one of a resistance divider, a capacitance divider, a resistance-capacitance divider, and a reactor divider.

The gamma reference voltage generating unit may further include a noise filter configured to filter a noise of the gamma reference voltage.

The gamma reference voltage generating unit may include a subtractor configured to receive an external reference voltage corresponding to the subtraction reference voltage, and to generate the gamma reference voltage by subtracting the external reference voltage from the first power voltage.

The gamma reference voltage generating unit may further include a noise filter configured to filter a noise of the gamma reference voltage.

Embodiments are also directed to a method of generating a gamma reference voltage for an organic light emitting display device, the method including receiving a first power voltage, generating a subtraction reference voltage based on an external reference voltage, and outputting the gamma reference voltage corresponding to a voltage difference between the first power voltage and the subtraction reference voltage.

The subtraction reference voltage may be generated by performing a voltage division on the external reference voltage.

The subtraction reference voltage may correspond to the external reference voltage.

The organic light emitting display device may operate based on an analog driving technique.

The gamma reference voltage may increase as the first power voltage increases, and a gamma voltage that is generated based on the gamma reference voltage may increase as the gamma reference voltage increases.

The gamma reference voltage may decrease as the first power voltage decreases, and a gamma voltage that is generated based on the gamma reference voltage may decrease as the gamma reference voltage decreases.

The method may further include filtering a noise of the gamma reference voltage.

BRIEF DESCRIPTION OF THE DRAWINGS

Features will become apparent to those of skill in the art by describing in detail example embodiments with reference to the attached drawings in which.

DETAILED DESCRIPTION

Figure 1:
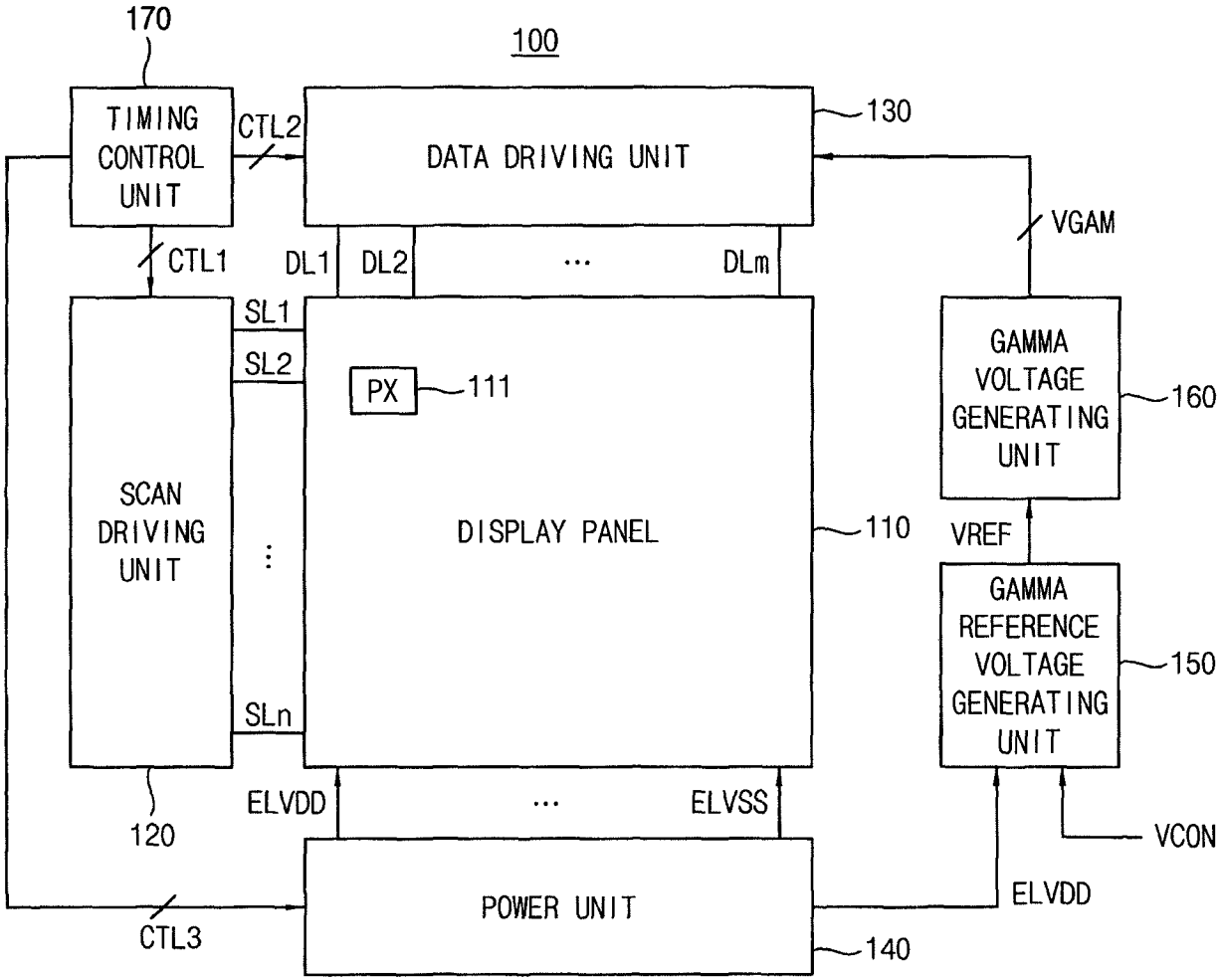
FIG. 1 is a block diagram illustrating an organic light emitting display device according to example embodiments.

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey the scope of the example embodiments to those skilled in the art.

In the drawing figures, dimensions may be exaggerated for clarity of illustration. Like reference numerals refer to like elements throughout.

It will be understood that when an element is referred to as being "on" another element, it can be directly on the other element, or one or more intervening elements may also be present. It will also be understood that when an element is referred to as being "under" another element, it can be directly under, or one or more intervening elements may also be present. It will also be understood that when an element is referred to as being "between" two elements, it can be the only element between the two elements, or one or more intervening elements may also be present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

It will be understood that, although the terms first, second, third, etc., may be used herein to describe various elements, these elements should not be limited by these terms. These terms are used to distinguish one element from another. Thus, a first element discussed below could be termed a second element without departing from the teachings of the present inventive concept. As used herein, the term "and/or" includes any and all combinations of one or more of the associated listed items.

The terminology used herein is for the purpose of describing particular example embodiments only and is not intended to be limiting of the present inventive concept. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

FIG. 1 is a block diagram illustrating an organic light emitting display device 100 according to example embodiments.

Referring to FIG. 1, the organic light emitting display device 100 may include a display panel 110, a scan driving unit 120, a data driving unit 130, a power unit 140, a gamma reference voltage generating unit 150, a gamma voltage generating unit 160, and a timing control unit 170. The organic light emitting display device 100 may employ an analog driving technique.

The display panel 110 may include a plurality of pixel circuits 111. In an example embodiment, the pixel circuit 111 may have a 2T-1C (i.e., two transistors and one capacitor) structure. For example, the pixel circuit 111 may include a switching transistor, a storage capacitor, a driving transistor, and an organic light emitting diode. A first terminal of the switching transistor may be coupled to one of data lines DL1 through DLm, a second terminal of the switching transistor may be coupled to a first node, and a gate terminal of the switching transistor may be coupled to one of scan lines SL1 through SLn. A first terminal of the storage capacitor may be coupled to a first power voltage ELVDD, and a second terminal of the storage capacitor may be coupled to the first node. A first terminal of the driving transistor may be coupled to the first power voltage ELVDD, a gate terminal of the driving transistor may be coupled to the first node, and a second terminal of the driving transistor may be coupled to an anode of the organic light emitting diode. A cathode of the organic light emitting diode may be coupled to a second power voltage ELVSS, and the anode of the organic light emitting diode may be coupled to the second terminal of the driving transistor. However, a structure of the pixel circuit 111 is not limited thereto. The organic light emitting diode of the pixel circuit 111 may emit light based on a current controlled by the driving transistor between the first power voltage ELVDD and the second power voltage ELVSS. In addition, the current flowing through the organic light emitting diode may be controlled by a voltage difference between the first terminal and the gate terminal of the driving transistor, where the storage capacitor is coupled between the first terminal and the gate terminal of the driving transistor. Thus, if the organic light emitting display device 100 generates the first power voltage ELVDD based on a voltage supplied from outside (e.g., an external DC-DC converter), the voltage difference between the first terminal and the gate terminal of the driving transistor may be changed when the first power voltage ELVDD is changed (e.g., if a ripple occurs) according to external circumstances. In this case, a luminance change may occur because the current flowing through the organic light emitting diode is changed, and thus the luminance change may result in image degradation (e.g., flicker, noise, etc), and wide luminance distribution.

The organic light emitting display device 100 may prevent the image degradation by adjusting a gamma voltage VGAM as the first power voltage ELVDD is changed. In an implementation, the organic light emitting display device 100 may increase a gamma reference voltage VREF as the first power voltage ELVDD increases according to external circumstances. As a result, a voltage of the first node may increase because the gamma voltage VGAM increases as the gamma reference voltage VREF increases. For example, the voltage difference between the first terminal and the gate terminal of the driving transistor may be maintained because the voltage of the first node (i.e., the voltage of the gate terminal of the driving transistor) increases as the first power voltage ELVDD (i.e., the voltage of the first terminal of the driving transistor) increases. As a result, the current flowing through the organic light emitting diode may be maintained because the voltage difference between the first terminal and the gate terminal of the driving transistor is maintained even when the first power voltage ELVDD increases according to external circumstances. Similarly, the organic light emitting display device 100 may decrease the gamma reference voltage VREF as the first power voltage ELVDD decreases according to external circumstances. As a result, the voltage of the first node may decrease because the gamma voltage VGAM decreases as the gamma reference voltage VREF decreases. For example, the voltage difference between the first terminal and the gate terminal of the driving transistor may be maintained because the voltage of the first node (i.e., the voltage of the gate terminal of the driving transistor) decreases as the first power voltage ELVDD (i.e., the voltage of the first terminal of the driving transistor) decreases. As a result, the current flowing through the organic light emitting diode may be maintained because the voltage difference between the first terminal and the gate terminal of the driving transistor is maintained even when the first power voltage ELVDD decreases according to external circumstances. Thus, the organic light emitting display device 100 may prevent the image degradation due to external circumstances. The above-described operation of the organic light emitting display device 100 may be performed by the gamma reference voltage generating unit 150.

The scan driving unit 120 may provide a scan signal to the pixel circuits 111 of the display panel 110 via the scan lines SL1 through SLn. The scan driving unit 120 may include at least one scan driving integrated circuit. The scan driving unit 120 may be located near to at least one side of the display panel 110. In addition, the scan driving unit 120 may be coupled to the display panel 110 using a chip-on-flexible printed circuit (COF), a chip-on-glass (COG), a flexible printed circuit (FPC), etc. The data driving unit 130 may provide a data signal to the pixel circuits 111 of the display panel 110 via the data lines DL1 through DLm. The data driving unit 130 may include at least one data driving integrated circuit. The data driving unit 130 may be located near to at least one side of the display panel 110. In addition, the data driving unit 130 may be coupled to the display panel 110 using the chip-on-flexible printed circuit (COF), the chip-on-glass (COG), the flexible printed circuit (FPC), etc. The power unit 140 may provide the first power voltage ELVDD and the second power voltage ELVSS to the pixel circuits 111 of the display panel 110, where the first power voltage ELVDD is greater than the second power voltage ELVSS. The power unit 140 may include at least one power supply circuit. The power unit 140 may be located near to at least one side of the display panel 110. In addition, the power unit 140 may be coupled to the display panel 110 using the chip-on-flexible printed circuit (COF), the chip-on-glass (COG), the flexible printed circuit (FPC), etc. In some example embodiments, the second power voltage ELVSS may be a ground voltage GND. However, the second power voltage ELVSS is not limited thereto. The timing control unit 170 may control at least one of the scan driving unit 120, the data driving unit 130, the power unit 140, the gamma reference voltage generating unit 150, and the gamma voltage generating unit 160. For convenience of descriptions, it is illustrated in FIG. 1 that the timing control unit 170 generates control signals CTL1, CTL2, and CTL3 to control the scan driving unit 120, the data driving unit 130, and the power unit 140. The timing control unit 170 may be coupled to the display panel 110 using the chip-on-flexible printed circuit (COF), the chip-on-glass (COG), the flexible printed circuit (FPC), etc.

The gamma reference voltage generating unit 150 may generate the gamma reference voltage VREF corresponding to the voltage difference between the first power voltage ELVDD and the subtraction reference voltage. In an implementation, the gamma reference voltage generating unit 150 may receive the first power voltage ELVDD and an external reference voltage VCON, may generate the subtraction reference voltage based on the external reference voltage VCON, and may generate the gamma reference voltage VREF by subtracting the subtraction reference voltage from the first power voltage ELVDD. In an example embodiment, the gamma reference voltage generating unit 150 may generate the subtraction reference voltage by performing a voltage division on the external reference voltage VCON. In this case, the gamma reference voltage generating unit 150 may include a voltage divider for performing the voltage division on the external reference voltage VCON such as a resistance divider, a capacitance divider, a resistance-capacitance divider, a reactor divider, etc. However, a type of the voltage divider is not limited thereto. In another example embodiment, the gamma reference voltage generating unit 150 may use the external reference voltage VCON as the subtraction reference voltage. In this case, the external reference voltage VCON may correspond to the subtraction reference voltage. The gamma reference voltage VREF may fluctuate as the first power voltage ELVDD fluctuates because the gamma reference voltage generating unit 150 generates the gamma reference voltage VREF based on the first power voltage ELVDD. For example, the gamma reference voltage VREF may increase as the first power voltage ELVDD increases, and the gamma reference voltage VREF may decrease as the first power voltage ELVDD decreases. The gamma voltage generating unit 160 may generate the gamma voltages VGAM based on the gamma reference voltage VREF, and may provide the gamma voltages VGAM to the data driving unit 130. The gamma voltages VGAM may fluctuate as the gamma reference voltage VREF fluctuates because the gamma voltage generating unit 160 generates the gamma voltages VGAM based on the gamma reference voltage VREF. For example, the gamma voltages VGAM may increase as the gamma reference voltage VREF increases, and the gamma voltages VGAM may decrease as the gamma reference voltage VREF decreases.

The data driving unit 130 may generate the data signal to be provided to the pixel circuits 111 of the display panel 110 based on the gamma voltages VGAM provided from the gamma voltage generating unit 160. Thus, the data signal may fluctuate as the first power voltage ELVDD fluctuates according to external circumstances. As described above, the organic light emitting display device 100 may increase the gamma reference voltage VREF as the first power voltage ELVDD increases according to external circumstances. The gamma voltages VGAM may increase as the gamma reference voltage VREF increases. Thus, the organic light emitting display device 100 may adjust the data signal as the first power voltage ELVDD increases according to external circumstances. In addition, the organic light emitting display device 100 may decrease the gamma reference voltage VREF as the first power voltage ELVDD decreases according to external circumstances. The gamma voltages VGAM may decrease as the gamma reference voltage VREF decreases. Thus, the organic light emitting display device 100 may adjust the data signal as the first power voltage ELVDD decreases according to external circumstances. Therefore, in the organic light emitting display device 100, the current flowing through the organic light emitting diode may be maintained because the voltage difference between the first terminal and the gate terminal of the driving transistor is maintained when the first power voltage ELVDD fluctuates according to external circumstances. As a result, the organic light emitting display device 100 may prevent the image degradation due to external circumstances. Although it is illustrated in FIG. 1 that the scan driving unit 120, the data driving unit 130, the power unit 140, the gamma reference voltage generating unit 150, the gamma voltage generating unit 160, and the timing control unit 170 are separately implemented, at least one of the scan driving unit 120, the data driving unit 130, the power unit 140, the gamma reference voltage generating unit 150, the gamma voltage generating unit 160, and the timing control unit 170 may be implemented by one chip. For example, the gamma reference voltage generating unit 150 and the gamma voltage generating unit 160 may be included in the data driving unit 130.

Figure 2:
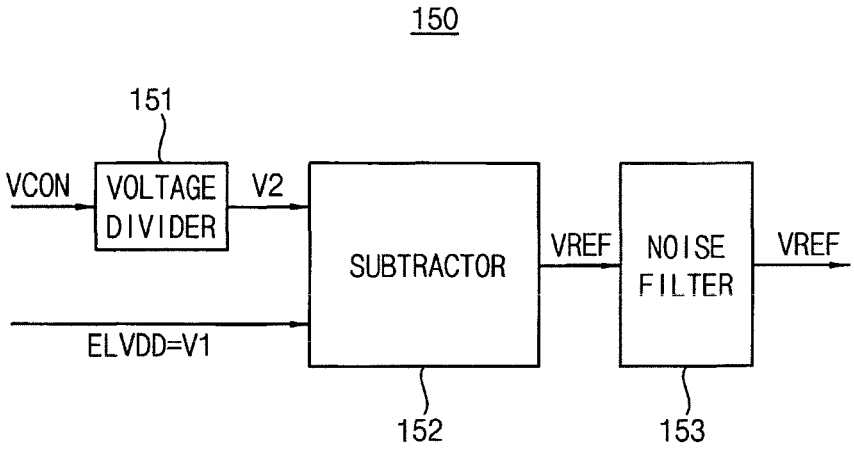
FIG. 2 is a block diagram illustrating an example of a gamma reference voltage generating unit included in an organic light emitting display device of FIG. 1.
Figure 3:
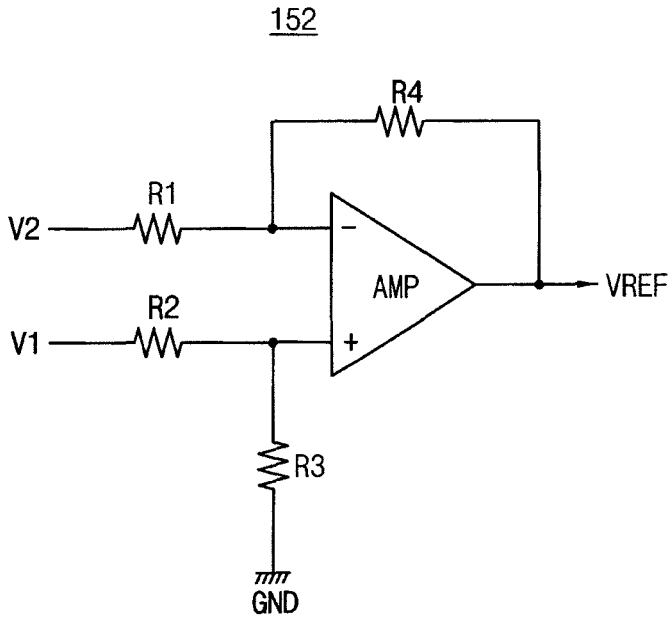
FIG. 3 is a circuit diagram illustrating a subtraction circuit included in a gamma reference voltage generating unit of FIG. 2.

FIG. 2 is a block diagram illustrating an example of a gamma reference voltage generating unit included in an organic light emitting display device of FIG. 1. FIG. 3 is a circuit diagram illustrating a subtraction circuit included in a gamma reference voltage generating unit of FIG. 2.

Referring to FIGS. 2 and 3, the gamma reference voltage generating unit 150 may include a voltage divider 151, a subtractor 152, and a noise filter 153.

The voltage divider 151 may receive the external reference voltage VCON from outside, and may generate the subtraction reference voltage V2 by performing a voltage division on the external reference voltage VCON. The voltage divider 151 may be a resistance divider, a capacitance divider, a resistance-capacitance divider, a reactor divider, etc. However, a type of the voltage divider 151 is not limited thereto. In some example embodiments, the gamma reference voltage generating unit 150 may generate the subtraction reference voltage V2 using a band-gap filter, etc instead of the voltage divider 151. The subtractor 152 may receive the first power voltage V1 (i.e., ELVDD) from the power unit 140, may receive the subtraction reference voltage V2 from the voltage divider 151, and may generate the gamma reference voltage VREF by subtracting the subtraction reference voltage V2 from the first power voltage V1. In an example embodiment, as illustrated in FIG. 3, the subtractor 152 may include an amplifier AMP and first through fourth resistors R1, R2, R3, and R4. The first resistor R1 may be coupled between a negative input terminal of the amplifier AMP and the subtraction reference voltage V2. The second resistor R2 may be coupled to a positive input terminal of the amplifier AMP and the first power voltage V1. The third resistor R3 may be coupled between the positive input terminal of the amplifier AMP and a ground voltage GND. The fourth resistor R4 may be coupled between an output terminal of the amplifier AMP and the negative input terminal of the amplifier AMP. The first resistor R1 and the second resistor R2 may have the same resistance, and the third resistor R3 and the fourth resistor R4 may have the same resistance. Thus, the gamma reference voltage VREF may be calculated using [Expression 1].

$$VREF = \frac{R4}{R1}(V1 - V2) \qquad \text{[Expression 1]}$$

(Here, VREF denotes the gamma reference voltage, V1 denotes the first power voltage, and V2 denotes the subtraction reference voltage.)

Therefore, when the first resistor R1 and the fourth resistor R4 have the same resistance, the gamma reference voltage VREF may be a value (i.e., V1−V2) generated by subtracting the subtraction reference voltage V2 from the first power voltage V1. Since a structure of FIG. 3 is exemplary, a structure of the subtractor 152 is not limited thereto. The noise filter 153 may eliminate a noise of the gamma reference voltage VREF. As described above, the gamma reference voltage generating unit 150 may be implemented with a simple structure having the voltage divider 151, the subtractor 152, and the noise filter 153 in order to generate the gamma reference voltage VREF corresponding to the voltage difference between the first power voltage V1 and the subtraction reference voltage V2. Hence, the gamma reference voltage generating unit 150 may have advantages for small size and low power consumption of the organic light emitting display device 100. In addition, the gamma reference voltage generating unit 150 may adjust the gamma reference voltage VREF as the first power voltage V1 fluctuates according to external circumstances because the gamma reference voltage generating unit 150 generates the gamma reference voltage VREF based on the first power voltage V1. As a result, in the organic light emitting display device 100 having the gamma reference voltage generating unit 150, the current flowing through the organic light emitting diode may be maintained because the voltage difference between the first terminal and the gate terminal of the driving transistor is maintained even when the first power voltage V1 fluctuates according to external circumstances.

Figure 4:
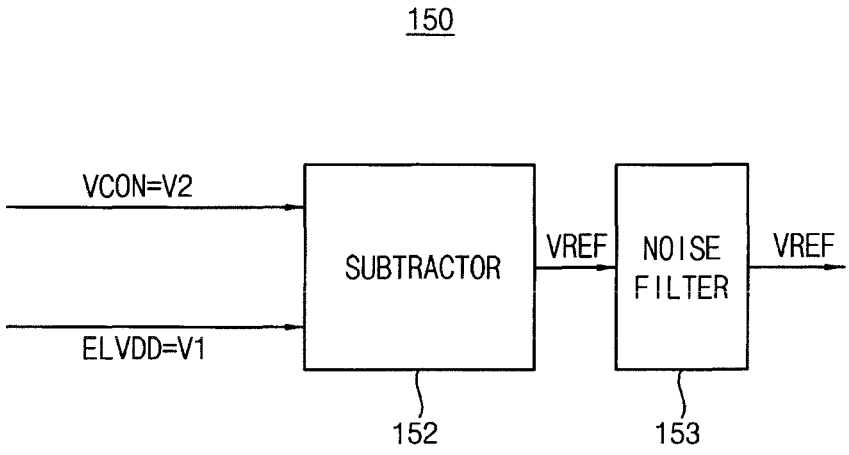
FIG. 4 is a block diagram illustrating another example of a gamma reference voltage generating unit included in an organic light emitting display device of FIG. 1.

FIG. 4 is a block diagram illustrating another example of a gamma reference voltage generating unit included in an organic light emitting display device of FIG. 1.

Referring to FIG. 4, the gamma reference voltage generating unit 150 may include a subtractor 152 and a noise filter 153. In other words, the gamma reference voltage generating unit 150 may use the external reference voltage VCON as the subtraction reference voltage V2. The subtractor 152 may receive the first power voltage V1 (i.e., ELVDD) from the power unit 140, may receive the subtraction reference voltage V2 (i.e., VCON) from outside, and may generate the gamma reference voltage VREF by subtracting the subtraction reference voltage V2 from the first power voltage V1. The noise filter 153 may eliminate a noise of the gamma reference voltage VREF. As described above, the gamma reference voltage generating unit 150 may be implemented with a simple structure having the subtractor 152 and the noise filter 153 in order to generate the gamma reference voltage VREF corresponding to the voltage difference between the first power voltage V1 and the subtraction reference voltage V2. Hence, the gamma reference voltage generating unit 150 may have advantages for small size and low power consumption of the organic light emitting display device 100. In addition, the gamma reference voltage generating unit 150 may adjust the gamma reference voltage VREF as the first power voltage V1 fluctuates according to external circumstances because the gamma reference voltage generating unit 150 generates the gamma reference voltage VREF based on the first power voltage V1. As a result, in the organic light emitting display device 100 having the gamma reference voltage generating unit 150, the current flowing through the organic light emitting diode may be maintained because the voltage difference between the first terminal and the gate terminal of the driving transistor is maintained even when the first power voltage V1 fluctuates according to external circumstances.

Figure 5:
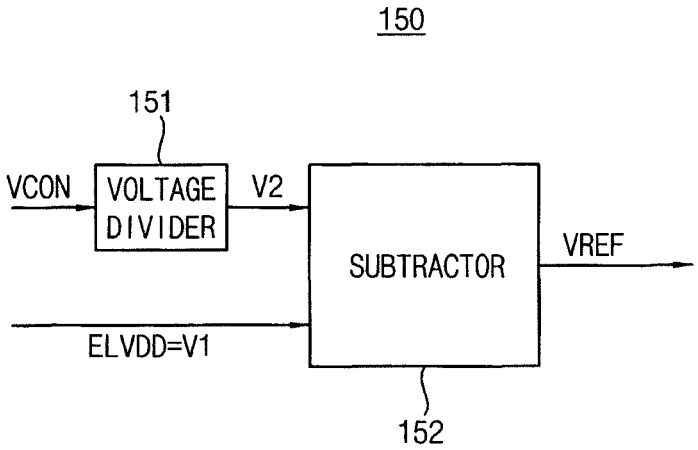
FIG. 5 is a block diagram illustrating still another example of a gamma reference voltage generating unit included in an organic light emitting display device of FIG. 1.

FIG. 5 is a block diagram illustrating still another example of a gamma reference voltage generating unit included in an organic light emitting display device of FIG. 1.

Referring to FIG. 5, the gamma reference voltage generating unit 150 may include a voltage divider 151 and a subtractor 152. The voltage divider 151 may receive the external reference voltage VCON from outside, and may generate the subtraction reference voltage V2 by performing a voltage division on the external reference voltage VCON. The voltage divider 151 may be a resistance divider, a capacitance divider, a resistance-capacitance divider, a reactor divider, etc. However, a type of the voltage divider 151 is not limited thereto. In some example embodiments, the gamma reference voltage generating unit 150 may generate the subtraction reference voltage V2 using a band-gap filter, etc., instead of the voltage divider 151. The subtractor 152 may receive the first power voltage V1 (i.e., ELVDD) from the power unit 140, may receive the subtraction reference voltage V2 from the voltage divider 151, and may generate the gamma reference voltage VREF by subtracting the subtraction reference voltage V2 from the first power voltage V1. As described above, the gamma reference voltage generating unit 150 may be implemented with a simple structure having the voltage divider 151 and the subtractor 152 in order to generate the gamma reference voltage VREF corresponding to the voltage difference between the first power voltage V1 and the subtraction reference voltage V2. Hence, the gamma reference voltage generating unit 150 may have advantages for small size and low power consumption of the organic light emitting display device 100. In addition, the gamma reference voltage generating unit 150 may adjust the gamma reference voltage VREF as the first power voltage V1 fluctuates according to external circumstances because the gamma reference voltage generating unit 150 generates the gamma reference voltage VREF based on the first power voltage V1. As a result, in the organic light emitting display device 100 having the gamma reference voltage generating unit 150, the current flowing through the organic light emitting diode may be maintained because the voltage difference between the first terminal and the gate terminal of the driving transistor is maintained even when the first power voltage V1 fluctuates according to external circumstances.

Figure 6:
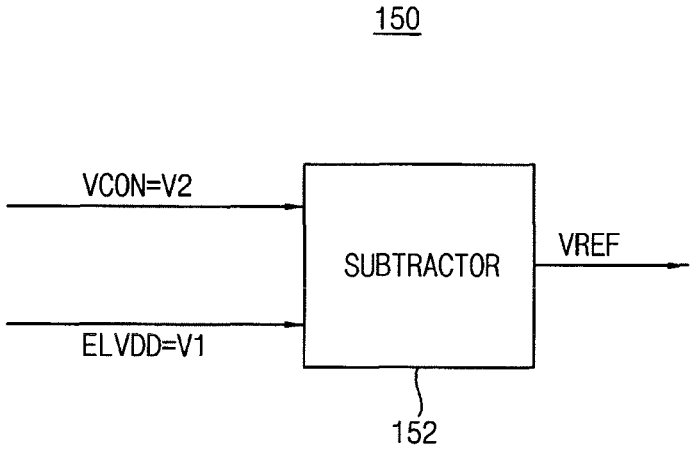
FIG. 6 is a block diagram illustrating still another example of a gamma reference voltage generating unit included in an organic light emitting display device of FIG. 1.

FIG. 6 is a block diagram illustrating still another example of a gamma reference voltage generating unit included in an organic light emitting display device of FIG. 1.

Referring to FIG. 6, the gamma reference voltage generating unit 150 may only include a subtractor 152. The gamma reference voltage generating unit 150 may correspond to the subtractor 152 that receives the first power voltage V1 (i.e., ELVDD) from the power unit 140, that receives the subtraction reference voltage V2 (i.e., VCON) from outside, and that generates the gamma reference voltage VREF by subtracting the subtraction reference voltage V2 from the first power voltage V1. The gamma reference voltage generating unit 150 may use the external reference voltage VCON as the subtraction reference voltage V2. Thus, the gamma reference voltage generating unit 150 may be implemented with a simple structure having the subtractor 152 in order to generate the gamma reference voltage VREF corresponding to the voltage difference between the first power voltage V1 and the subtraction reference voltage V2. Hence, the gamma reference voltage generating unit 150 may have advantages for small size and low power consumption of the organic light emitting display device 100. In addition, the gamma reference voltage generating unit 150 may adjust the gamma reference voltage VREF as the first power voltage V1 fluctuates according to external circumstances because the gamma reference voltage generating unit 150 generates the gamma reference voltage VREF based on the first power voltage V1. As a result, in the organic light emitting display device 100 having the gamma reference voltage generating unit 150, the current flowing through the organic light emitting diode may be maintained because the voltage difference between the first terminal and the gate terminal of the driving transistor is maintained even when the first power voltage V1 fluctuates according to external circumstances.

Figure 7:
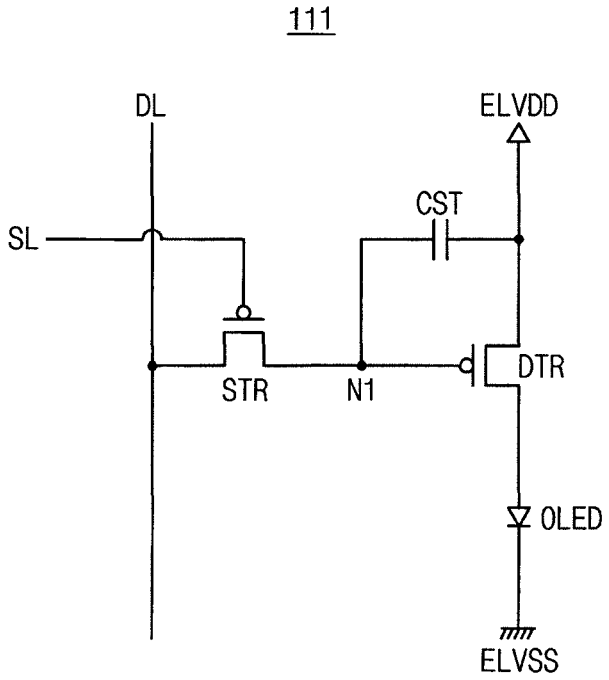
FIG. 7 is a circuit diagram illustrating a pixel circuit of a display panel included in an organic light emitting display device of FIG. 1.
Figure 8A:
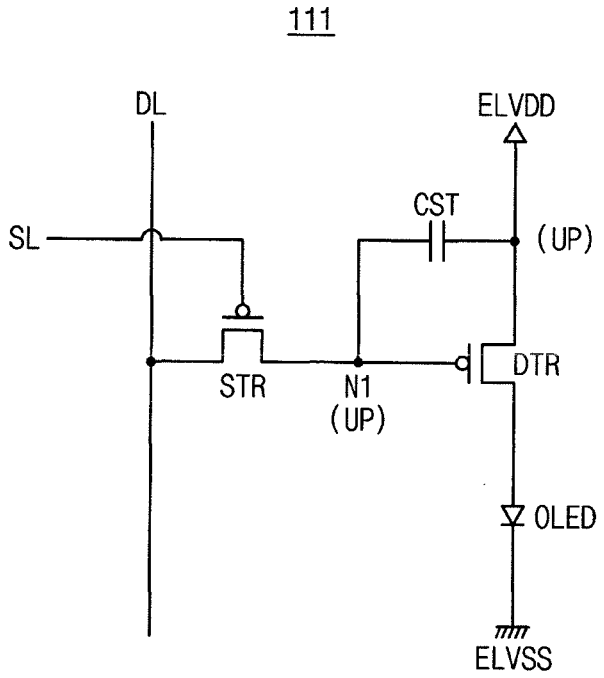
FIGS. 8A and 8B are diagrams illustrating how an organic light emitting display device of FIG. 1 improves luminance distribution characteristics.
Figure 8B:
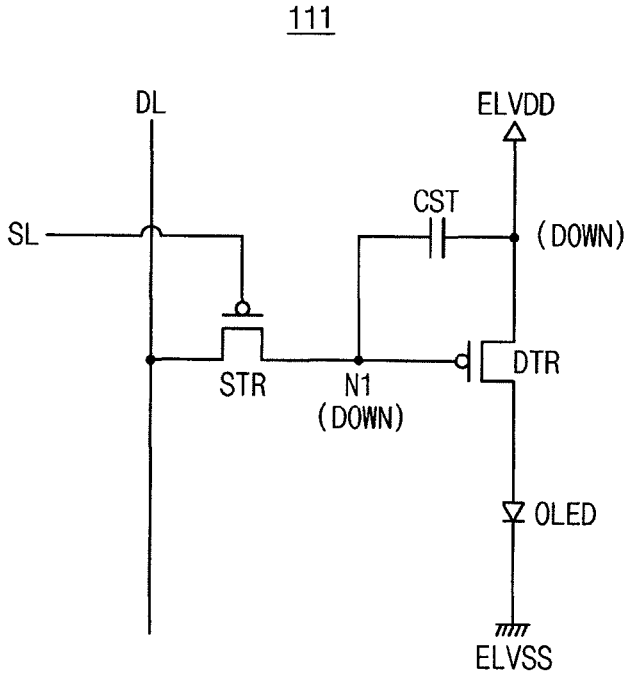

FIG. 7 is a circuit diagram illustrating a pixel circuit of a display panel included in an organic light emitting display device of FIG. 1. FIGS. 8A and 8B are diagrams illustrating how an organic light emitting display device of FIG. 1 improves luminance distribution characteristics.

Referring to FIGS. 7, 8A, and 8B, the organic light emitting display device 100 may operate based on an analog driving technique. Each pixel circuit 111 may include a switching transistor STR, a storage capacitor CST, a driving transistor DTR, and an organic light emitting diode OLED. A first terminal of the switching transistor STR may be coupled to a data line DL, a second terminal of the switching transistor STR may be coupled to a first node N1, and a gate terminal of the switching transistor STR may be coupled to a scan line SL. A first terminal of the storage capacitor CST may be coupled to a first power voltage ELVDD, and a second terminal of the storage capacitor CST may be coupled to the first node N1. A first terminal of the driving transistor DTR may be coupled to the first power voltage ELVDD, a gate terminal of the driving transistor DTR may be coupled to the first node N1, and a second terminal of the driving transistor DTR may be coupled to an anode of the organic light emitting diode OLED. A cathode of the organic light emitting diode OLED may be coupled to a second power voltage ELVSS, and the anode of the organic light emitting diode OLED may be coupled to the second terminal of the driving transistor DTR. The organic light emitting diode OLED may emit light based on a current controlled by the driving transistor DTR between the first power voltage ELVDD and the second power voltage ELVSS. For example, the current flowing through the organic light emitting diode OLED may be controlled by a voltage difference between the first terminal and the gate terminal of the driving transistor DTR, where the storage capacitor CST is coupled between the first terminal and the gate terminal of the driving transistor DTR.

As illustrated in FIG. 8A, in the organic light emitting display device 100, the gamma reference voltage VREF may increase as the first power voltage ELVDD increases (i.e., indicated as UP) according to external circumstances, and the gamma voltage VGAM may also increase as the gamma reference voltage VREF increases. As a result, a voltage of the first node N1 may increase (i.e., indicated as UP). Therefore, the current flowing through the organic light emitting diode OLED may be maintained because the voltage difference between the first terminal and the gate terminal of the driving transistor DTR is maintained even when the first power voltage ELVDD increases (i.e., indicated as UP) according to external circumstances. Similarly, as illustrated in FIG. 8B, in the organic light emitting display device 100, the gamma reference voltage VREF may decrease as the first power voltage ELVDD decreases (i.e., indicated as DOWN) according to external circumstances, and the gamma voltage VGAM may also decrease as the gamma reference voltage VREF decreases. As a result, the voltage of the first node N1 may decrease (i.e., indicated as DOWN). Therefore, the current flowing through the organic light emitting diode OLED may be maintained because the voltage difference between the first terminal and the gate terminal of the driving transistor DTR is maintained even when the first power voltage ELVDD decreases (i.e., indicated as DOWN) according to external circumstances. In conclusion, the organic light emitting display device 100 may prevent the image degradation (e.g., flicker, noise, etc.), and may improve luminance distribution characteristics (i.e., may narrow luminance distribution) based on the gamma reference voltage generating unit 150 that adjusts the gamma reference voltage VREF when the first power voltage ELVDD fluctuates.

Figure 9:
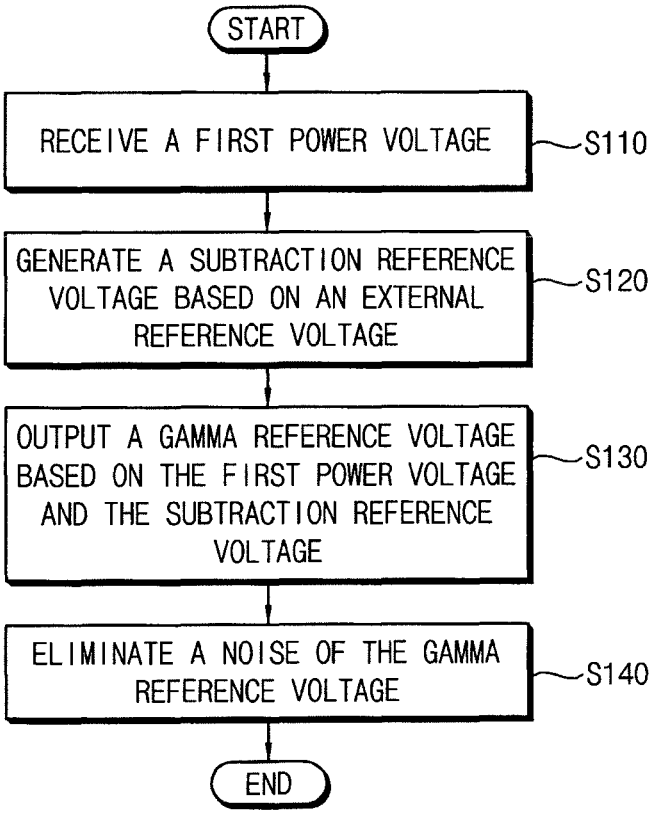
FIG. 9 is a flow chart illustrating a method of generating a gamma reference voltage according to example embodiments.

FIG. 9 is a flow chart illustrating a method of generating a gamma reference voltage according to example embodiments.

Referring to FIG. 9, the method of FIG. 9 may receive a first power voltage (Operation S110), may generate a subtraction reference voltage based on an external reference voltage (Operation S120), and may output a gamma reference voltage corresponding to a voltage difference between the first power voltage and the subtraction reference voltage (Operation S130) for an organic light emitting display device employing an analog driving technique. In some example embodiments, the method of FIG. 9 may reduce or eliminate, i.e., filter, a noise of the gamma reference voltage (Operation S140). In an example embodiment, the subtraction reference voltage may be generated by performing a voltage division on the external reference voltage. In another example embodiment, the subtraction reference voltage may correspond to the external reference voltage. As described above, since the gamma reference voltage is generated by subtracting the subtraction reference voltage from the first power voltage, the gamma reference voltage may be adjusted when the first power voltage fluctuates according to external circumstances. In an implementation, the method of FIG. 9 may increase the gamma reference voltage when the first power voltage increases according to external circumstances. In this case, the gamma voltage that is generated based on the gamma reference voltage may increase. As a result, a data signal may be adjusted when the first power voltage increases according to external circumstances. Similarly, the method of FIG. 9 may decrease the gamma reference voltage when the first power voltage decreases according to external circumstances. In this case, the gamma voltage that is generated based on the gamma reference voltage may decrease. As a result, the data signal may be adjusted when the first power voltage decreases according to external circumstances. Since these operations are described above, details thereof will not be repeated.

Figure 10:
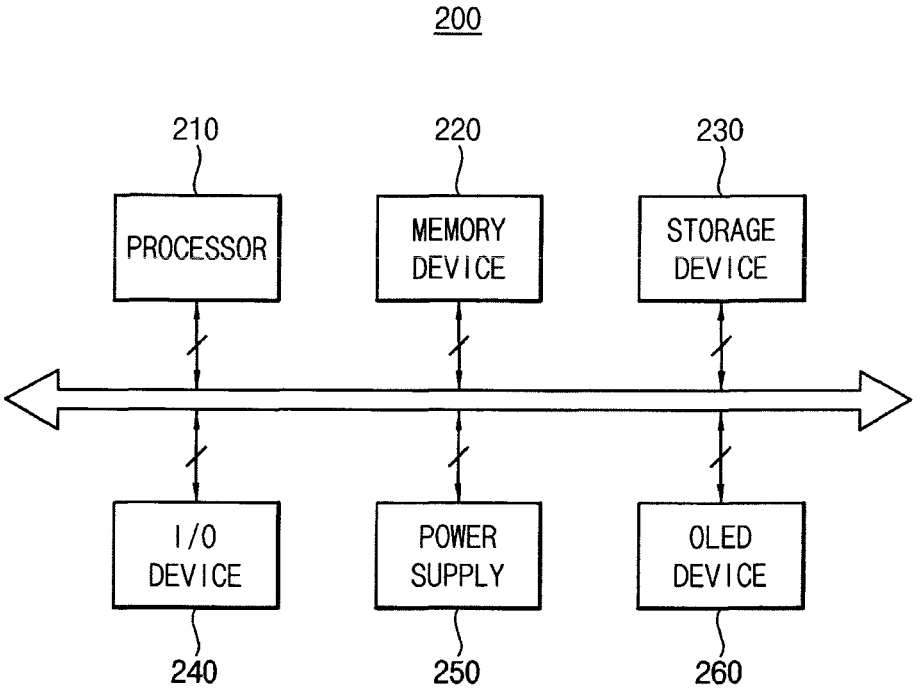
FIG. 10 is a block diagram illustrating an electronic device having an organic light emitting display device according to example embodiments.

FIG. 10 is a block diagram illustrating an electronic device having an organic light emitting display device according to example embodiments.

Referring to FIG. 10, the electronic device 200 may include a processor 210, a memory device 220, a storage device 230, an input/output (I/O) device 240, a power supply 250, and an organic light emitting display device 260. The organic light emitting display device 260 may correspond to the organic light emitting display device 100 of FIG. 1. In addition, the electronic device 200 may further include a plurality of ports for communicating a video card, a sound card, a memory card, a universal serial bus (USB) device, other electronic devices, etc.

The processor 210 may perform various computing functions. The processor 210 may be a micro processor, a central processing unit (CPU), etc. The processor 210 may be coupled to other components via an address bus, a control bus, a data bus, etc. Further, the processor 210 may be coupled to an extended bus such as a peripheral component interconnection (PCI) bus. The memory device 220 may store data for operations of the electronic device 200. For example, the memory device 220 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc., and/or at least one volatile memory device such as a dynamic random access memory (DRAM) device, a static random access memory (SRAM) device, a mobile DRAM device, etc. The storage device 230 may be a solid state drive (SSD) device, a hard disk drive (HDD) device, a CD-ROM device, etc. The I/O device 240 may be an input device such as a keyboard, a keypad, a touchpad, a touch-screen, a mouse, etc., and an output device such as a printer, a speaker, etc. In some example embodiments, the organic light emitting display device 260 may be included in the I/O device 240. The power supply 250 may provide a power for operations of the electronic device 200.

The organic light emitting display device 260 may communicate with other components via the buses or other communication links. In an example embodiment, the organic light emitting display device 260 may employ an analog driving technique (i.e., may operate based on an analog driving technique). The organic light emitting display device 260 may include a display panel, a scan driving unit, a data driving unit, a power unit, a gamma reference voltage generating unit, a gamma voltage generating unit, and a timing control unit, etc. The gamma reference voltage generating unit may generate a gamma reference voltage corresponding to a voltage difference between a first power voltage (e.g., ELVDD) and a subtraction reference voltage. Thus, the gamma reference voltage may increase as the first power voltage increases according to external circumstances, and a gamma voltage may increase as the gamma reference voltage increases. Similarly, the gamma reference voltage may decrease as the first power voltage decreases according to external circumstances, and the gamma voltage may decrease as the gamma reference voltage decreases. As a result, a current flowing through an organic light emitting diode of each pixel circuit may be maintained even when the first power voltage fluctuates according to external circumstances. As described above, since the organic light emitting display device 260 includes the gamma reference voltage generating unit that adjusts the gamma reference voltage as the first power voltage fluctuates according to external circumstances, the organic light emitting display device 260 may prevent an image degradation (e.g., flicker, noise, etc.) due to external circumstances, and may improve luminance distribution characteristics (i.e., may narrow luminance distribution).

Embodiments may be applied to an electronic device having an organic light emitting display device. For example, embodiments may be applied to a television, a computer monitor, a laptop, a digital camera, a cellular phone, a smart phone, a smart pad, a personal digital assistant (PDA), a portable multimedia player (PMP), an MP3 player, a navigation system, a game console, a video phone, etc.

By way of summation and review, pixel circuits of a display panel may each have a 2T-1C (i.e., two transistors and one capacitor) structure. Each pixel circuit may include a switching transistor, a driving transistor, a storage capacitor, and an organic light emitting diode (OLED). The organic light emitting diode may emit light based on a current controlled by the driving transistor between a first power voltage ELVDD and a second power voltage ELVSS. The current flowing through the organic light emitting diode may be controlled by a voltage difference between a source terminal and a gate terminal of the driving transistor, where the storage capacitor is coupled between the source terminal and the gate terminal of the driving transistor. A general organic light emitting display device may generate the first power voltage ELVDD based on a voltage supplied from outside (e.g., an external DC-DC converter). Accordingly, when the first power voltage ELVDD is changed (e.g., a ripple occurs) according to external circumstances, the current flowing through the organic light emitting diode of each pixel circuit may be changed because the voltage difference between the source terminal and the gate terminal of the driving transistor is changed. Thus, a luminance change may occur when the first power voltage ELVDD is changed according to external circumstances in the conventional organic light emitting display device. The luminance change may result in image degradation (e.g., flicker, noise, etc), and wide luminance distribution in the conventional organic light emitting display device.

As described above, embodiments relate to an organic light emitting display device that operates based on a first power voltage ELVDD and a second power voltage ELVSS, and a method of generating a gamma reference voltage for the organic light emitting display device. Example embodiments may provide an organic light emitting display device capable of reducing or preventing image degradation (e.g., flicker, noise, etc.), and of improving luminance distribution characteristics (i.e., narrowing luminance distribution) by adjusting a gamma reference voltage when a first power voltage fluctuates. Example embodiments may provide a method of generating a gamma reference voltage capable of preventing image degradation, and of improving luminance distribution characteristics (i.e., narrowing luminance distribution) by adjusting a gamma reference voltage when a first power voltage fluctuates.

An organic light emitting display device according to example embodiments may generate a gamma reference voltage by subtracting a subtraction reference voltage from a first power voltage. Thus, the gamma reference voltage may be adjusted when the first power voltage is changed (i.e., fluctuates). As a result, the organic light emitting display device may reduce or prevent image degradation, and may improve luminance distribution characteristics.

In addition, a method of generating a gamma reference voltage according to example embodiments may generate a gamma reference voltage by subtracting a subtraction reference voltage from a first power voltage for an organic light emitting display device. Thus, the gamma reference voltage may be adjusted when the first power voltage is changed (i.e., fluctuates). As a result, the organic light emitting display device may reduce or prevent image degradation, and may improve luminance distribution characteristics.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims.

What is claimed is:

1. An organic light emitting display device, comprising:

a display panel having a plurality of pixel circuits;

a scan driving unit to provide a scan signal to the pixel circuits via a plurality of scan lines;

a data driving unit to provide a data signal to the pixel circuits via a plurality of data lines;

a power unit to provide a first power voltage and a second power voltage to the pixel circuits, the first power voltage being greater than the second power voltage;

a gamma reference voltage generating unit to generate a gamma reference voltage as a voltage difference between the first power voltage and a subtraction reference voltage, the voltage difference being generated by subtracting the subtraction reference voltage from the first power voltage;

a gamma voltage generating unit to generate a plurality of gamma voltages using the gamma reference voltage as the voltage difference being generated by subtracting the subtraction reference voltage from the first power voltage, and to provide the gamma voltages to the data driving unit; and a timing control unit to control at least one of the scan driving unit, the data driving unit, the power unit. the gamma reference voltage generating unit, and the gamma voltage generating unit, wherein the gamma reference voltage is changed by the change of the first power voltage when the first power voltage is changed.

2. The device as claimed in claim 1, wherein the device operates based on an analog driving technique.

3. The device as claimed in claim 2, wherein each of the pixel circuits includes:

a switching transistor having a first terminal coupled to one of the data lines, a second terminal coupled to a first node, and a gate terminal coupled to one of the scan lines;

a storage capacitor having a first terminal coupled to the first power voltage and a second terminal coupled to the first node;

a driving transistor having a first terminal coupled to the first power voltage and a gate terminal coupled to the first node; and an organic light emitting diode having a cathode coupled to the second power voltage and an anode coupled to a second terminal of the driving transistor.

4. The device as claimed in claim 3, wherein the gamma reference voltage increases as the first power voltage increases, the gamma voltage increases as the gamma reference voltage increases, and a voltage of the first node increases as the gamma voltage increases.

5. The device as claimed in claim 3, wherein the gamma reference voltage decreases as the first power voltage decreases, the gamma voltage decreases as the gamma reference voltage decreases, and a voltage of the first node decreases as the gamma voltage decreases.

6. The device as claimed in claim 3, wherein the at least one of the scan driving unit, the data driving unit, the power unit, the gamma reference voltage generating unit, and the gamma voltage generating unit is coupled to the display panel using a chip-on-flexible printed circuit, a chip-on-glass, or a flexible printed circuit.

7. The device as claimed in claim 1, wherein the gamma reference voltage generating unit includes:

a voltage divider to generate the subtraction reference voltage by performing a voltage division on an external reference voltage received from outside; and a subtractor to generate the gamma reference voltage by subtracting the subtraction reference voltage from the first power voltage.

8. The device as claimed in claim 7, wherein the voltage divider corresponds to at least one of a resistance divider, a capacitance divider, a resistance-capacitance divider, and a reactor divider.

9. The device as claimed in claim 7, wherein the gamma reference voltage generating unit further includes a noise filter to filter a noise of the gamma reference voltage.

10. The device as claimed in claim 1, wherein the gamma reference voltage generating unit includes a subtractor to receive an external reference voltage corresponding to the subtraction reference voltage, and to generate the voltage difference as the gamma reference voltage by subtracting the external reference voltage from the first power voltage.

11. The device as claimed in claim 10, wherein the gamma reference voltage generating unit further includes a noise filter to filter a noise of the gamma reference voltage.

12. A method of generating a gamma reference voltage for an organic light emitting display device, the method comprising:

receiving a first power voltage;

generating a subtraction reference voltage based on an external reference voltage;

outputting the gamma reference voltage as a voltage difference between the first power voltage and the subtraction reference voltage, the voltage difference being generated by subtracting the subtraction reference voltage from the first power voltage; and generating a plurality of gamma voltages using the gamma reference voltage as the voltage difference being generated by subtracting the subtraction reference voltage from the first power voltage, wherein the gamma reference voltage is changed by the change of the first power voltage when the first power voltage is changed.

13. The method as claimed in claim 12, wherein the subtraction reference voltage is generated by performing a voltage division on the external reference voltage.

14. The method as claimed in claim 12, wherein the subtraction reference voltage corresponds to the external reference voltage.

15. The method as claimed in claim 12, wherein the organic light emitting display device operates based on an analog driving technique.

16. The method as claimed in claim 15, wherein the gamma reference voltage increases as the first power voltage increases, and the plurality of gamma voltages increase as the gamma reference voltage increases.

17. The method as claimed in claim 15, wherein the gamma reference voltage decreases as the first power voltage decreases, and the plurality of gamma voltages decreases as the gamma reference voltage decreases.

18. The method as claimed in claim 12, further comprising filtering a noise of the gamma reference voltage.

* * * * *